US007325804B2

(12) United States Patent
Bowling

(10) Patent No.: US 7,325,804 B2
(45) Date of Patent: Feb. 5, 2008

(54) GAME APPARATUS WITH AN ENCAPSULATED FIGURE

(76) Inventor: Stephen Bowling, 28 Intervale Rd., Stamford, CT (US) 06905

( * ) Notice: Subject to any disclaimer, the term of this patent is extended or adjusted under 35 U.S.C. 154(b) by 0 days.

(21) Appl. No.: 10/699,919

(22) Filed: Nov. 3, 2003

(65) Prior Publication Data

US 2005/0093237 A1 May 5, 2005

(51) Int. Cl.
*A63F 3/00* (2006.01)

(52) U.S. Cl. ..... 273/255; 273/262; 273/288

(58) Field of Classification Search ..... 273/255, 273/146, 262, 288
See application file for complete search history.

(56) References Cited

U.S. PATENT DOCUMENTS 3,856,309 A * 12/1974 Helfgott ..... 273/288
3,904,208 A * 9/1975 Grossman ..... 273/146
4,030,762 A * 6/1977 Gilmore ..... 273/248
4,116,439 A * 9/1978 Chavarria et al. ..... 473/52
4,846,476 A * 7/1989 Hanna ..... 273/144 A
4,884,818 A * 12/1989 Fogarty ..... 273/256
5,372,366 A * 12/1994 Gohlke ..... 273/274
5,649,874 A * 7/1997 Headford et al. ..... 473/569
5,692,753 A * 12/1997 Falk ..... 273/248
5,820,126 A * 10/1998 Moore ..... 273/253
6,533,275 B2 * 3/2003 Zaruba et al. ..... 273/146
6,581,932 B2 * 6/2003 Jacobs ..... 273/236
6,585,265 B2 * 7/2003 Dewa et al. ..... 273/243
2002/0109298 A1 * 8/2002 Zaruba et al. ..... 273/292

* cited by examiner

*Primary Examiner*—Vishu K. Mendiratta

(57) ABSTRACT

A game piece in the nature of a hand manipulated capsule containing a visible and recognizable figure with assigned characteristics, a game field, and a method of using the game piece in the playing of games.

8 Claims, 3 Drawing Sheets

GAME APPARATUS WITH AN ENCAPSULATED FIGURE

FIELD OF THE INVENTION

This invention relates to a game involving game pieces that are spheres, globes, marbles, cubes, cones, and/or polyhedrons all of which will be herein generally referred to as sphere or capsule, which encapsulate a visibly recognizable figure that has a distinct identity. Each identity has a predetermined set of abilities and points that are used strategically in the game in a specified field of play. The game involves skill in manipulating the game piece, strategy in determining which game piece to manipulate during a turn for a beneficial outcome, and luck which involves a random element of chance, such as a roll of a die, to determine the outcome of an end result of the manipulation of a game piece.

The sphere includes an internally embedded readily recognizable figure and/or characteristics which may be representative of fanciful characters, mythical characters, comic book characters, actual individuals living or deceased, actual sports persons, generic sports players, famous persons, well known personalities, recognizable individuals, movie stars, cinematic characters, creatures, powers, abilities, magic spells, cures, nullifiers, apparatus, devices, weapons, bombs, or land mines, all of which will be herein generally referred to as figure.

BACKGROUND OF THE INVENTION

Games with marbles such as Chinese checkers and games involving the shooting of marbles against each other to manipulate the opponent's position are old and well known and it is extremely well known for marbles to have colorful swirls and patterns inside. It has been known on occasion for artists to put inside a marble a decorative item or for a marble to have a decorative picture painted on its surface. Similarly, rubber balls have contained items within. There have been many games for marbles involving elaborate tracks and boards designed with grooves and holes. However, there have been no teachings of a marble or sphere or capsule with a visible representation of a specific character contained inside that uses this specific identity to play a game.

Previous marble games and marble toys have in general placed the emphasis on the device for the marble to be played on or with, shot through or rolled within, with the marble itself becoming merely an instrument used for the device to function.

SUMMARY OF THE INVENTION

It is the object of the invention to provide a unique and challenging game toy that is adaptable and fun for all age groups, employing a capsule that contains a visible and recognizable figure with a distinct identity that is utilized for the playing of the game in a playing field.

It is an object of the invention to use representations of real people as well as representations of fictional personalities and popular fanciful characters for the figure inside the capsule.

It is an object of the invention for game piece capsules to be designed in sets and collected.

It is a further object of the invention for game piece capsules to be designed in sets representing professional sports teams, each piece with a different player from that team, which can be collected and displayed and/or can be used in a game corresponding to the team's particular sport and statistics, with a game board representing the playing field of that sport.

This concept of the present invention reverses past models of marble toys and games and places the emphasis on the marble itself with its recognizable figure within, each having a specific identity important to the play and outcome.

The marble or capsule represents a force field or energy shield that protects the figure within and is activated by the figure when needed. The shield protects the figure from attacks from other figures, yet allows him to attack and use his abilities and powers. A crew of heroes protects their world or territory from various groups of villains. Each game piece character, hero or villain, has a name, a history, a weapon and/or power, and a designated system of points and symbols that determine the outcome of battles against another team or teams of game pieces. Each game piece becomes strategic to the game because of its distinct identity and how the player decides to use the piece. By manipulating the game piece by rolling, flicking, sliding, or launching that piece into the playing field a player must strike an opponent's marble or capsule in order to attack or create a battle that is regulated by the field of play and the designated points which the game pieces possess. This game utilizes a method of points combined with a physical action on a playing field that requires skill and a random event such as the roll of dice.

Therefore, it is a feature of the exemplary embodiments to provide a novel game toy, game, and a method of playing a game.

Some embodiments may include one or more of the following features.

In one embodiment, a game apparatus includes a game piece in the nature of a hand manipulated capsule containing a visible figure with a distinct identity. The figure may be representative of an individual character with a distinct personality. The figure may be representative of a characteristic, representing specific abilities. The figure may be representative of a device. The figure may be representative of a generic sports position team player. Multiple capsules may be provided wherein each capsule has a different character.

The figure may have a designation representing ability characteristics utilized by the game piece. Each figure may have a designation representing defensive characteristics utilized by the game piece. Each game piece may have a corresponding card that gives the player all the information regarding that game piece needed to play the game.

The capsule may be spherical and the figure may be embedded in and visible through the capsule. The capsule may be in the shape of a cube, polyhedron, disc, cylinder, or cone.

Means for projecting the game piece may be included with the game apparatus.

Specific game pieces may be used to designate the playing field, being placed periodically along a real or imaginary line of the periphery of the playing field. A game board that designates outlined shapes for the boundaries of the playing field may also be provided. The shape designating the boundaries of the playing field may have markings along the periphery of the shape to periodically place specific game pieces used to designate a section for a player to operate within.

In another embodiment, the invention may comprise a marble with an encapsulated recognizable figure with a distinct identity, the figure being visible within the marble.

The figure may be representative of an individual character with a distinct personality. A set of multiple marbles may be provided, wherein each marble has a different character.

In yet another embodiment, the invention may comprise a method of initiating a hand manipulated playing piece in a designated playing field where each game piece has an individual identity responsible for triggering an action on the game field. Moving a specific game piece may accomplish a required event in accord with a plan in response only to the instructions of the particular pieces that are involved in that event. Each player may manipulate game pieces in a chosen order in accordance with characteristics of the pieces, with the pieces of other players reacting in accord with their individual characteristics with action and reaction of the pieces determining the outcome of the games.

An embodiment of the method may include one or more of the following steps.

A specific playing field may be provided or determined in which each player is aware of the boundaries of the field and each player has a designated section of the length of the periphery of the playing field to operate within.

Each player may choose a team of game pieces for his squadron so that each team game piece has a distinct identity, different from the other players team game pieces' identities, and each team game piece having a designated number for defense and for attack. Each player may further designate a commander or leader of his squadron of team game pieces which, if removed from the game, can create a detrimental effect on the attack numbers of the remaining team game pieces.

Each player may place at least one of his game pieces in the approximate center of the playing field or a mutually agreed upon central area of the playing field. A means for determining the starting order of the players may be provided.

Going in turn, each player may use a game piece from his reserves, those not in the playing field but still active in the game, or choose a team game piece already in the playing field, and, without entering the playing field with any part of his body and staying within the confines of his playing section, manipulate his game piece by rolling, flicking, sliding, or propelling it at a game piece of another player. If, during his turn of play, the player's team game piece strikes an opponent's team game piece or strikes multiple opponents' team game pieces and forces the opponent's team game piece out of the playing field, the defense number of the team game piece forced out of the playing field may be decreased by half, and that team game piece forced out of the playing field may be returned to the approximate center or central area of the field. If the opponent's team game piece remains in the playing field those playing pieces may remain where landed and the player may use a device to produce a random outcome such as rolling dice, to determine the effect of the strike, in accord with a plan, by using a multiplier and/or a subtraction or addition of the attack number of the player's team game piece which is then subtracted from the defense number of all opponents' team game pieces struck. If the result of the strike is that the defense number of a team game piece is zero or below, that team game piece may be removed from the game.

If the outcome of the dice role denotes that the player may call on his reserves, the initial strike may be determined by rolling the dice again until it does not denote reserve, and he may then pick a game piece from those that are not in the playing field and manipulate it into the field of play to strike again at any opponent's pieces, any team game piece used from his reserves may be returned to his reserves after his turn of play, unless he has no game pieces left in his reserve, in which case he may not be permitted to strike again.

If the player's team game piece lands in the playing field it may stay where it landed. If the player's team game piece lands outside the playing field, it may be returned to the approximate center or central area of the field. If, during his turn of play, the player's team game piece propelled into the playing field touches no other game piece of an opponent, the team game piece may stay where it lands unless it lands outside the playing field, in which case it may be returned to the approximate center or central area of the field.

If, during his turn of play, the player's team game piece propelled into the playing field strikes one or more of his own team game pieces, each struck team game piece may stay where it lands unless it lands outside the playing field in which case it may be removed from being active in the playing field and returned to the player's reserves, until the player decides to enter it into the playing field again.

If, during his turn of play, the player's team game piece propelled into the playing field strikes his own team game piece or an opponent's team game piece and this struck piece hits any other team game piece in the field of play, the secondary hit piece may stay where it lands, unless it lands outside the playing field in which case it may be returned to the central area of the playing field.

If, during his turn of play, a player uses a special game piece that is earned by andlor given to each player at the start of and/or during the game, in accord with a plan, which can affect a team game piece by giving it an advantage or a disadvantage because it represents a power, an ability, a weapon, a device, a bomb, a land mine, a magic spell, a protection, a defensive shield, a cure, a nullifier, or a special condition that affect the results of a strike or battle on the playing field, and propels it into the playing field, and it strikes an appropriate game piece, then it may be considered activated and the advantage or disadvantage this affords takes effect in accord with a plan, irrespective of game piece it was intended for, for the remainder of the game or for a specified number of turns of play, after which it may removed from the playing field and cannot be used again.

If a special game piece is of a type that needs to touch another game piece to be activated, and it does not touch any other game piece but it lands in the field of play, it may be considered un-activated and may remain in the field of play where it landed until a game piece touches it, in which case it may become active and the game piece that touched it gets the advantage or disadvantage it affords for the remainder of the game or for a specified number of turns of play, after which it may be removed from the playing field and cannot be used again, unless the game piece that touches it is one that nullifies or destroys it, after which it may be removed from the playing field and cannot be used again. If a special game piece is of a type that needs to touch another game piece to be activated and it does not strike any other game piece and it lands outside the playing field it may be deactivated and cannot be used again.

If a special game piece is of the type that does not need to touch another game piece to be activated and lands in the field of play it may become activated and takes effect on all or certain game pieces, in accord with a plan, for a specified number of turns of play or until it touches a game piece that nullifies or destroys it, after which it may be removed from the playing field and cannot be used again. If a special game piece is of the type that does not need to hit another game piece to be activated and it lands outside the playing field it may be deactivated and cannot be used again.

If, during the game, a players team game piece's defense number is reduced to zero or below, that game piece may be removed from the game. If, during the game a player's team game piece is removed from the game or the playing field and that player has no other team game pieces left in the playing field, that player may put into the playing field another team game piece, unless that player does not have another team game piece that is not a special game piece, left in the game in which case the player may be out of the game. The last player left with a team game piece on the playing field may win the game.

The above steps may be repeated until only one player is left with a game piece in the playing field.

Other objects, features and advantages of the invention will become apparent from a consideration of the following detailed description and the accompanying drawings.

DETAILED DESCRIPTION OF THE PREFERRED EMBODIMENTS

Figure 1A:
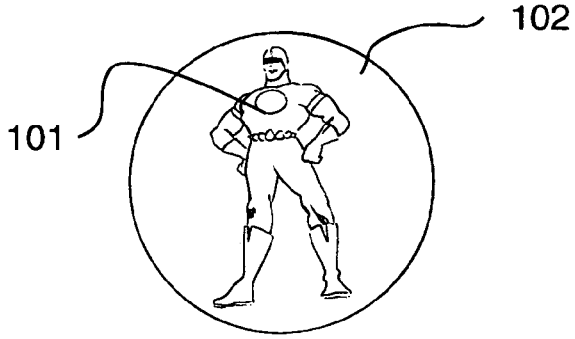
FIG. 1A-FIG. 1D are illustrative views showing exemplary capsules with a figure inside embodying features of this invention.
Figure 1B:
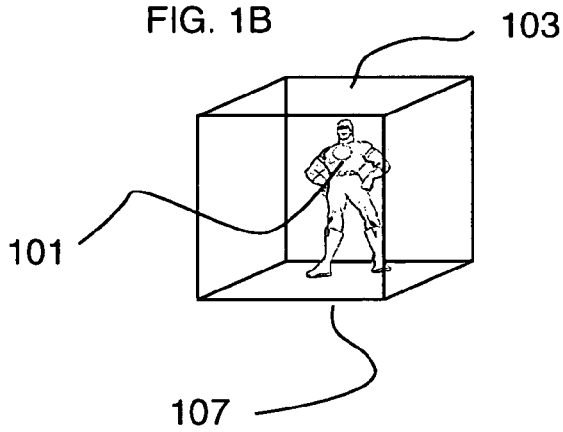
Figure 1C:
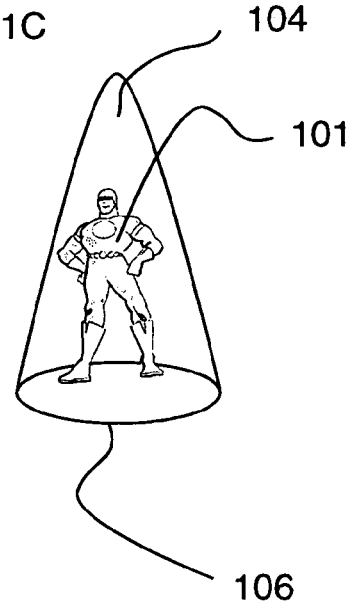
Figure 1D:
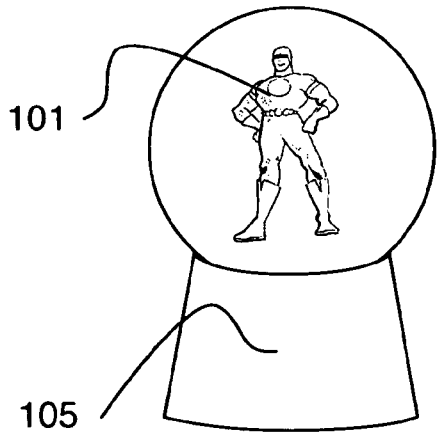
Figure 2A:
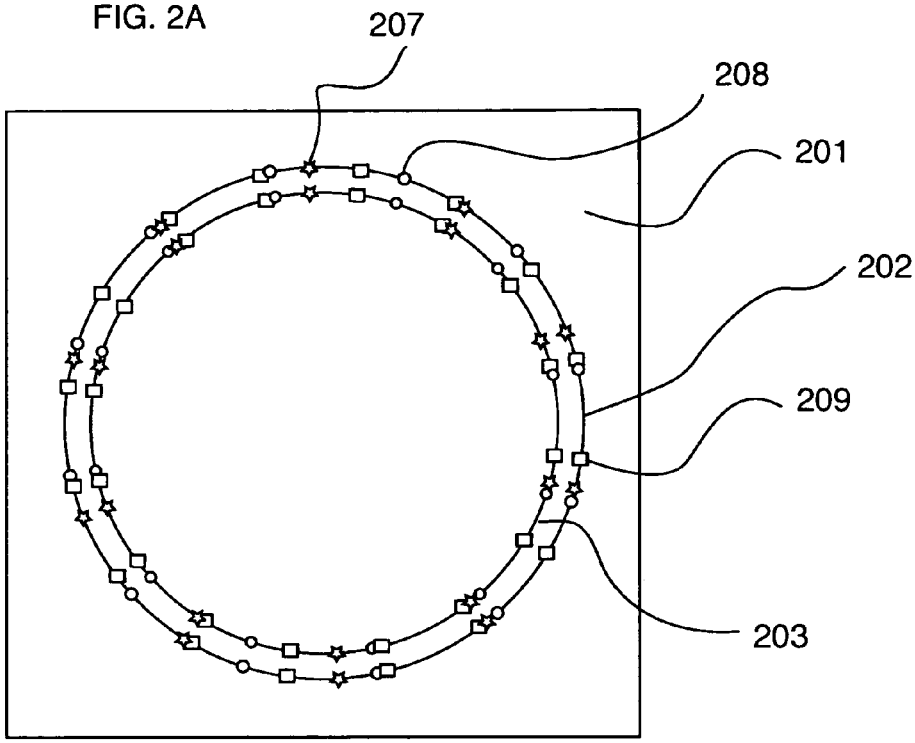
FIG. 2A-FIG. 2B are illustrative views of game boards embodying features of this invention.
Figure 2B:
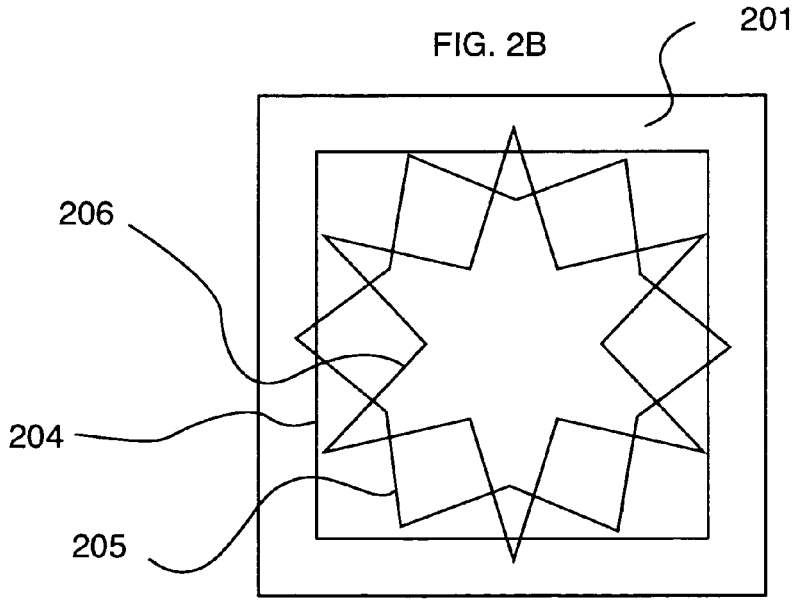
Figure 3:
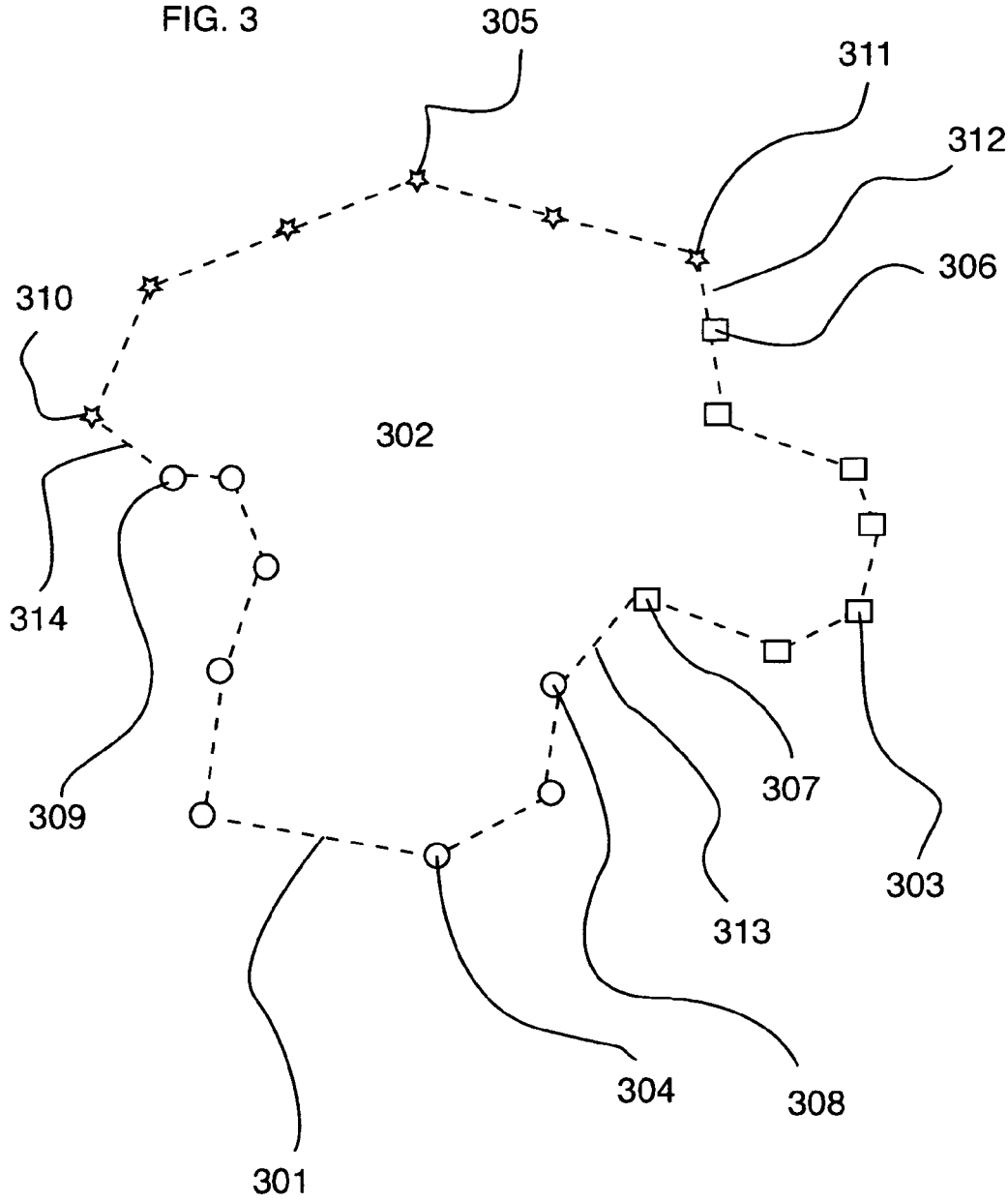
FIG. 3 is an illustrative view of a playing field using only game pieces that are used to outline the playing field embodying features of this invention.

A game toy apparatus of an embodiment according to this invention includes exemplary capsules with an encapsulated figure shown in FIG. 1A-FIG. 1D, a game board as shown in FIG. 2A-FIG. 2B, a game field of play which is set by the players in FIG. 3.

As shown in FIG. 1A-FIG. 1D the game includes a manipulated game piece in the from of a transparent or translucent capsule that encapsulates a FIG. 101. The preferred embodiments are made of glass or plastic and are in the shape of a sphere or globe 102 that can be rolled FIG. 1A, a cube 103 that can be slid FIG. 1B, or a cone 104 that can be slid FIG. 1C, however other shapes and other materials may be contemplated within the scope of the invention. The encapsulation of the figure may comprise embedding the figure in a solid glass or plastic sphere such as a marble, or positioning the sphere within a hollow sphere or capsule, either fixed or moveable.

As shown in FIG. 2A-FIG. 2B the game includes a game board 201 that designates specific shapes 202-206 for a specified field of play, which preferred embodiments are a circle 202-203, a square 204, or star 205-206 shape, outlined in different ways, by color for example, to distinguish each for game play. Other shapes and configurations may be contemplated and are within the scope of the invention. Specified fields of play can have a resemblance to professional sports playing fields, battlefields, or fanciful places and incorporate pictures of terrain or fanciful objects. The encapsulated FIG. 101 shown in FIG. 1A-FIG. 1D can correspond to the sports game or fanciful place simply by encapsulating the appropriate type of character. In the embodiment of FIG. 2A, the circular shapes 202-203 have designations for two, three, or four 207-209 players although more may play. Two players have ten designations represented here by stars 207, five for each equal side of play, three players have twelve designations represented here by circles 208, four for each equal side of play, and four players have sixteen designations represented here by squares 209, four for each equal side of play. These designations are used to place or fix in place game pieces specifically used for this purpose that are more likely to stay in position with a feature such as a flat bottom 106-107 as shown in FIG. 1B-FIG. 1D or a base 105 and can be any shape.

Another embodiment of the game playing field FIG. 3 allows the players to set their own area of play with game pieces specifically used for this purpose designed to stay in position FIG. 1C-FIG. 1D with a feature such as a flat bottom 106-107 or a base 105. These game pieces can be any shape, and are placed or fixed in place periodically along a path to outline the playing field FIG. 3. An imaginary boundary line 301 is shown in FIG. 3 formed by the stationary game pieces, here represented by squares 303, circles 304, and stars 305, of each player placed periodically along the imagined border of the field of play 301, which outlines the actual field of play 302. A playing field can be any shape as shown by the odd shape in FIG. 3 and a player's side of play can be of any length along the drawn or imaginary border of the playing field. A side or section of play is the area or length of the periphery of the playing field 301 where a player may enter his game piece into the playing field by hand manipulating the game piece or projecting it by means of a launcher. FIG. 3 illustrates each player's side of play for a game, here shown for of a total of three players. Player X has a side of play represented here by the squares 303 extending from square 306 to square 307, player Y has a side of play represented here by the circles 304 extending from circle 308 to circle 309, player Z has a side of play represented here by the stars 305 extending from star 310 to star 311. The space 312 between star 311 and square 306, the space 313 between square 307 and circle 308, and the space 314 between circle 309 and star 310 are neutral game areas and no player may use them for his side of play.

Another embodiment of the game FIG. 101 as shown in FIG. 1A-FIG. 1D allows the encapsulated FIG. 101 to be part of a collectable and expandable set that corresponds to sports teams, super heroes, fanciful characters, animals, creatures, or cinematic characters, which can be used in the game or displayed for viewing the collection. Other sets of figures may be contemplated within the scope of the invention.

An actual playing of the game can include, as an example, rolling, flicking, sliding, or launching a playing piece in a designated playing field FIG. 2A-FIG. 2B, FIG. 3, each game piece having an individual identity, with abilities particular to its identity that are responsible for triggering an action on the game field. Moving a particular game piece and accomplishing a required event, such as striking another game piece, creates a situation which includes the pieces that were involved in the event, with action and reaction of the pieces determining the outcome of the game. Each player going in turn and using his game pieces strategically, determining which piece or pieces to use during his turn, taking into consideration each game piece's distinct identity and characteristics and his opponent's pieces' distinct identities and characteristics, while evaluating which pieces are in the playing field, which are vulnerable, and which are in a player's reserve of game pieces not yet in the field. Each game piece having a number designated for attack, and defense, which is used to subtract from an opponent player's defense number until a game piece's defense number goes to zero or below, in which case that game piece is removed from the game.

An actual playing of the game can include, as an example, the following steps. The players first choose the playing field by either using a playing board FIG. 2A-FIG. 2B, or using designated pieces that map out the playing field FIG. 3, either of which determine each player's section of the playing periphery to play from, which is the area or length of the periphery of the playing field 301 where a player may enter his game piece into the playing field without entering the playing field with any part of his body. An example of the player's section is shown in FIG. 3. One player has a side represented here by the squares 303 from which he may operate within, extending from square 306 to square 307, A second player has a side represented here by the circles 304 from which he may operate within, extending from circle 308 to circle 309, and in this example of a three player game, the third player has a side represented here by the stars. Each player then chooses his team of game pieces. These pieces, the team game pieces, are a player's crew or squadron that will battle other player's crew or squadrons. All team game pieces must have different figures to be part of the team, and, in general, each player will start with the same amount of team game pieces. However the players can start with a different number of team game pieces for each player taking into account the skill of the players or abilities of the game pieces, if they so desire. Each player designates a team game piece as the commander or leader of the squadron. If this team game piece is removed from the game, a detrimental effect is placed on the remaining team game pieces by a lowering of their attack numbers. Once the crew of team game pieces has been selected, each player places a team game piece of his choice in the approximate center or an agreed upon central area of the playing field. The rest of his team game pieces are considered in his reserves, which are those game pieces not in the playing field but still active in the game. The players then determine which player goes first and in what order the other player go by rolling the dice.

The further steps of this example of an actual playing of the game involve each player going in turn by choosing a team game piece that is already in the playing field or a game piece from his reserves, those not already in the playing field, and manipulating that piece into the playing field by rolling, flicking, sliding or launching it, without any part of his body entering the playing field and while staying within the confines of his playing section of the periphery of the playing field. The player may choose a team game piece that is a member of his squadron, knowing that if all of his team game pieces are removed from the game then he is out of the game. Or the player may choose a game piece that is considered a special game piece that is earned by, bought by, or given to the players at the start of or during the game. This type of special game piece can represent a power, an ability, a weapon, a device, a bomb, a land mine, a magic spell, a protection, a defensive shield, a cure, a nullifier, or a special condition that affects the results of a strike or battle on the playing field. Special game pieces are different in type. One type is used to either strike your own team game piece to give it an advantage or to strike your opponent's team game piece to give it a disadvantage, which lasts for the remainder of the game or for a specified number of turns of play. If this type of special game piece is used and it strikes any team game piece, it is activated and the advantage or disadvantage takes effect irrespective of the game piece for which it was intended. Once this type of special game piece has been activated it cannot be used again and is removed from the playing field. If this type of special game piece is manipulated into the field of play by a player and it does not strike any other game piece but it lands in the field of play it is considered un-activated and remains in the field of play until a team game piece touches it, in which case it becomes active and the team game piece that touched it gets the advantage or disadvantage it affords. It is then removed from the game and cannot be used again. If this type of special game piece is manipulated into the field of play by a player and it does not strike any other game piece and lands outside the field of play it is considered deactivated and cannot be used again. Another type of special game piece creates a condition on the field of play that all or certain game pieces are affected by for a specified number of turns of play. A third type of special game piece nullifies, cures, or destroys other game pieces. These two types of special game pieces may or may not be required to strike another game piece, or they may need to be struck by a game piece to activate, and can be used only once and are removed from the field of play after their use has ended. If they land outside the playing field they are deactivated and cannot be used again.

Still further steps of this example of an actual playing of the game include a player, after choosing one of his game pieces to use during his turn of play, entering that piece into the playing field with the intention of striking a game piece of another player's team or one of his own game pieces. If he choose to use a team game piece and strikes a team game piece of another player and knocks it out of the playing field, that opponent's team game piece has its' defense number reduced by half and it is returned to the approximate center or central area of the playing field. Once a team game piece has its defense number reduced to zero or below that team game piece is removed from the game. If a player's team game piece is removed from the game and he has no other team game pieces in the playing field, he must choose another team game piece and place it in the approximate center or central area of the playing field. If he has no other team game pieces left, he is out of the game. If the player's team game piece strikes another player's team game piece and it lands in the field of play a battle ensues, the result of which is determined by the attack number, playing field conditions if any have been established by special game pieces, the type or kind of abilities, weapons and defensive protections the team game piece possesses, the defense number and the kind of abilities, weapons and defensive protections the team game piece that was struck possesses, and by the roll of a die or dice or a device to produce a random outcome in which a particular outcome has a specific result. The attack number of the player's team game piece, after all determinations of that number have been established, are subtracted from the defense number, after all determinations of that number have been established, of the opponent player's team game piece. If the player strikes two or more opponent's team game pieces, the attack number determined as described above, is used for subtraction against the defense number of the team game piece struck first and is then reduced by half and subtracted from the defense numbers of the opponent's team game pieces struck after the first. If the struck piece's defense number is reduced to zero or below it is removed from the game. If the player strikes his own team game piece the team game pieces stay where they land and the next player has his turn, unless those team game pieces land outside the playing field in which case the team game piece used is placed in the approximate center or central area of the playing field and the team game piece struck is put in reserve, and not put back in the playing field until the player decides to use it. This allows a player to remove one of his own team game pieces strategically from the playing field. If a player's team game piece strikes any team game piece and that team game piece strikes another team game piece, the secondary struck team game piece stays where it lands unless it lands outside the playing field in which case it is returned to the approximate center or central area of the playing field. If the player's team game piece lands outside the playing field after striking another piece or without striking another piece it is placed in the approximate center or central area of the playing field.

Additionally further steps of this example of an actual playing of the game are if a player's game piece strikes another game piece and he is required to roll a die or dice or use a device to produce a random outcome and that outcome is denoted as reserve, then the player may use another game piece from his reserve, which are those game pieces not in the playing field but are still active in the game, to enter into the playing field. The initial strike is again determined as above unless a reserve is the outcome again in which case the strike is determined again until something other then reserve is the outcome. The next game piece from his reserve follows the procedures set out above for the particular type of game piece. Any game piece the player possesses in his reserve may be used, unless the player has no game pieces in his reserve in which case his turn is over. If the player uses a team game piece from his reserve it is returned to his reserve once his turn of play is over.

This game uses skill in manipulating the game piece into the playing field at a target, luck in that the outcome of a strike on the target is partly determined by a random device such as dice, and strategy in analyzing: all the conditions of attack and defense possessed by his team game pieces and the other players' team game pieces; the difficulty of achieving a strike against a particular target; the conditions set by a special game piece, if any; the players skill levels; which game pieces are active on the playing field and which are in the players' reserves.

Although the present invention has been described and illustrated in detail, it is clearly understood that the same is by way of illustration and example only and is not to be taken by way of limitation, the spirit and scope of the present invention being limited only by the means of the appended claims.

What is claimed is:

1. A method of playing a game comprising the steps of:

a) providing a plurality of striking spheres, with each player receiving at least one sphere having a visible figure associated with it;

b) providing an indicia on a substrate, the indicia describing a value of its corresponding visible figure;

c) providing a random number generator that comprises at least one die;

d) placing a first sphere inside a defined playing field;

e) a player physically striking the first sphere inside the playing field with a second sphere, wherein one of the two contacting spheres is the player's sphere with an associated visible figure;

f) using the random number generator to generate a number;

g) using the number together with the indicia to modify the value of the corresponding visible figure of the player's sphere; and h) determining an outcome of the strike from the difference between the modified value of the visible figure of the player's sphere and a value of a figure associated with an opponent's sphere.

2. The method of claim 1, wherein the playing field is defined using a plurality of markers.

3. The method of claim 1, wherein the playing field is defined using a game surface.

4. The method of claim 1, wherein the position of the first sphere in relation to the playing field after the second sphere strikes the first sphere is a factor in determining the outcome.

5. The method of claim 1, further comprising the step of removing the first sphere from the playing field after being struck by the second sphere.

6. The method of claim 1, further comprising the step of repositioning the first sphere in the playing field after being struck by the second sphere.

7. The method of claim 1, wherein the indicia are provided on at least one card.

8. A method of playing a game comprising the steps of:

a) providing a plurality of spheres, with each player receiving at least one sphere having a visible figure associated with it;

b) providing an indicia on a substrate, the indicia describing a value of its corresponding visible figure;

c) providing a random number generator;

d) placing a first sphere inside a defined playing field;

e) a player launching the second sphere from outside the playing field to physically strike the first sphere, wherein one of the two contacting spheres is the player's sphere with an associated visible figure;

f) using the random number generator to generate a number;

g) using the number together with the indicia to modify the value of the corresponding visible figure of the player's sphere; and h) determining an outcome of the strike from the difference between the modified value of the visible figure of the player's sphere and a value of a figure associated with an opponent's sphere.

* * * * *